US010978806B2

(12) United States Patent
Garrido Lopez et al.

(10) Patent No.: US 10,978,806 B2
(45) Date of Patent: Apr. 13, 2021

(54) ELECTRONIC DEVICE SLOT ANTENNAS

(71) Applicant: Apple Inc., Cupertino, CA (US)

(72) Inventors: David Garrido Lopez, Campbell, CA (US); Harish Rajagopalan, San Jose, CA (US); Umar Azad, Santa Clara, CA (US); Rodney A. Gomez Angulo, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 390 days.

(21) Appl. No.: 16/141,793

(22) Filed: Sep. 25, 2018

(65) Prior Publication Data

US 2020/0099138 A1 Mar. 26, 2020

(51) Int. Cl.

| | |
|---|---|
| ***H01Q 1/24*** | (2006.01) |
| ***H01Q 13/10*** | (2006.01) |
| ***H01Q 9/04*** | (2006.01) |
| ***H01Q 9/42*** | (2006.01) |
| ***H01Q 21/28*** | (2006.01) |
| ***H01Q 21/30*** | (2006.01) |

(52) U.S. Cl.

CPC ..... *H01Q 13/103* (2013.01); *H01Q 1/243* (2013.01); *H01Q 9/0407* (2013.01); *H01Q 9/42* (2013.01); *H01Q 21/28* (2013.01); *H01Q 21/30* (2013.01)

(58) Field of Classification Search

CPC combination set(s) only.

See application file for complete search history.

(56) References Cited

U.S. PATENT DOCUMENTS

| | | | |
|---|---|---|---|
| 9,648,150 | B1 | 5/2017 | Zhao et al. |
| 9,876,273 | B2 | 1/2018 | Lui et al. |
| 2015/0116159 | A1 | 4/2015 | Chen et al. |

FOREIGN PATENT DOCUMENTS

| | | | |
|---|---|---|---|
| EP | 2885839 | B1 | 4/2017 |

OTHER PUBLICATIONS

Harish Rajagopalan et al., U.S. Appl. No. 15/716,363, filed Sep. 26, 2017.

*Primary Examiner* — Graham P Smith

(74) *Attorney, Agent, or Firm* — Treyz Law Group, P.C.; Michael H. Lyons

(57) ABSTRACT

An electronic device may be provided an antenna, a display, and a housing. The display may include a conductive display structure and a cover layer. The housing may include peripheral conductive structures and a conductive rear wall. The peripheral structures may include a ledge separated from the conductive display structure by a gap. The peripheral structures and the rear wall may define opposing edges of a slot element for the antenna. Conductive bridging structures may be coupled between the conductive display structure and the ledge across the gap. The bridging structures may at least partially overlap locations along the length of the slot element where antenna currents around the slot element exhibit a maximum magnitude. The bridging structures may align the phase of current induced on the ledge with the phase of the current induced on the conductive display structure to maximize antenna efficiency through the cover layer.

20 Claims, 9 Drawing Sheets

ELECTRONIC DEVICE SLOT ANTENNAS

BACKGROUND

This relates to electronic devices, and more particularly, to antennas for electronic devices with wireless communications circuitry.

Electronic devices such as portable computers and cellular telephones are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies in one or more directions with satisfactory efficiency bandwidth.

It would therefore be desirable to be able to provide improved wireless communications circuitry for wireless electronic devices.

SUMMARY

An electronic device may be provided with wireless circuitry, a conductive housing, and a display. The display may include a conductive display structure and a display cover layer that overlaps the conductive display structure. The conductive housing may include peripheral conductive housing structures and a conductive rear housing wall. The peripheral conductive housing structures may include a ledge separated from the conductive display structure by a gap. The display cover layer may be mounted to the ledge using adhesive.

The wireless circuitry may include one or more antennas such as a wireless local area network antenna. The peripheral conductive housing structures and the conductive rear housing wall may define opposing edges of an antenna resonating element such as a slot element for the antenna. The slot element may convey radio-frequency signals through the rear face of the device. The slot element may also convey radio-frequency signals through the gap and the display cover layer. If care is not taken, the slot element may induce out-of-phase currents on the conductive display structure and the ledge that limit efficiency for the antenna through the display cover layer.

In order to mitigate these effects, one or more conductive bridging structures may be coupled between the conductive display structure and the ledge across the gap. The conductive bridging structures may at least partially overlap locations along the length of the slot element where antenna currents around the slot element exhibit a maximum magnitude. For example, the conductive bridging structures may overlap one or more edges of the slot element. If desired, the conductive bridging structures may be coupled to the conductive rear housing wall at a location aligned with an antenna tuning element that is coupled across the slot element. The conductive bridging structures may serve to align the phase of the current induced on the ledge with the phase of the current induced on the conductive display structure to maximize antenna efficiency through the display cover layer.

DETAILED DESCRIPTION

Figure 1:
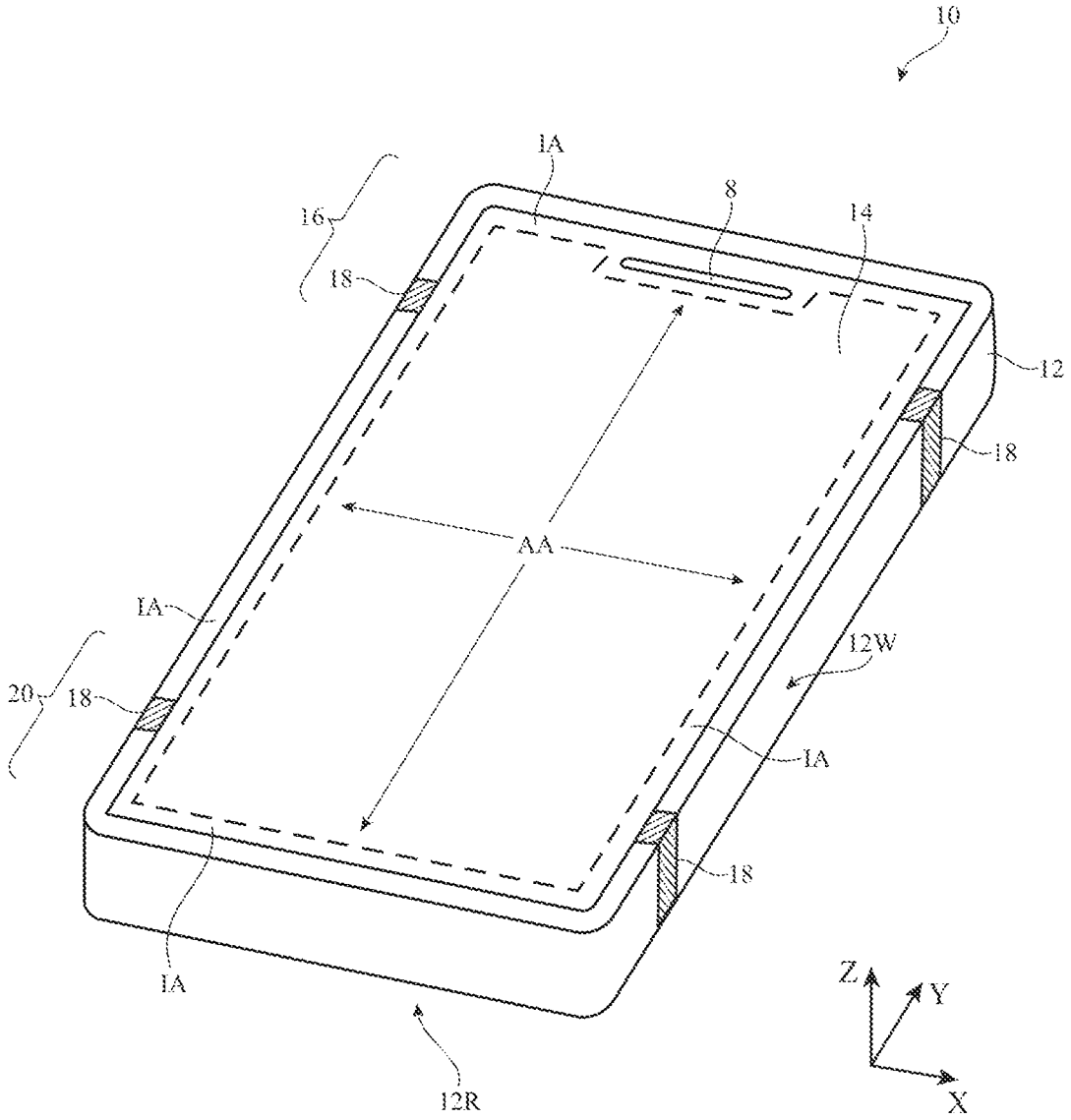
FIG. 1 is a perspective view of an illustrative electronic device in accordance with an embodiment.

An electronic device such as electronic device 10 of FIG. 1 may be provided with wireless circuitry that includes antennas. The antennas may be used to transmit and receive wireless signals.

The wireless circuitry of device 10 may handle one or more communications bands. For example, the wireless circuitry of device 10 may include a Global Position System (GPS) receiver that handles GPS satellite navigation system signals at 1575 MHz or a GLONASS receiver that handles GLONASS signals at 1609 MHz. Device 10 may also contain wireless communications circuitry that operates in communications bands such as cellular telephone bands and wireless circuitry that operates in communications bands such as the 2.4 GHz Bluetooth® band and the 2.4 GHz and 5 GHz Wi-Fi® wireless local area network bands (sometimes referred to as IEEE 802.11 bands or wireless local area network communications bands). Device 10 may also contain wireless communications circuitry for implementing near-field communications at 13.56 MHz or other near-field communications frequencies. If desired, device 10 may include wireless communications circuitry for communicating at 60 GHz, circuitry for supporting light-based wireless communications, or other wireless communications.

The wireless communications circuitry may include antenna structures. The antenna structures may include antennas for wireless local area network communications and/or other far-field (non-near-field) communications. The antenna structures may include loop antenna structures, inverted-F antenna structures, strip antenna structures, planar inverted-F antenna structures, slot antenna structures, hybrid antenna structures that include antenna structures of more than one type, or other suitable antenna structures.

Conductive structures for the antenna structures may, if desired, be formed from conductive electronic device structures.

The conductive electronic device structures may include conductive housing structures. The conductive housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Peripheral structures 12W and rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding lip that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

If desired, rear housing wall 12R may be formed from a metal such as stainless steel or aluminum and may sometimes be referred to herein as conductive rear housing wall 12R or conductive rear wall 12R. Conductive rear housing wall 12R may lie in a plane that is parallel to display 14. In configurations for device 10 in which rear housing wall 12R is formed from metal, it may be desirable to form parts of peripheral conductive housing structures 12W as integral portions of the housing structures forming the conductive rear housing wall of housing 12. For example, conductive rear housing wall 12R of device 10 may be formed from a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Conductive rear housing wall 12R may have one or more, two or more, or three or more portions. Peripheral conductive housing structures 12W and/or the conductive rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 12W and/or 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 8 or a microphone port. Openings may be formed in housing 12 to form communications ports (e.g., an audio jack port, a digital data port, etc.) and/or audio ports for audio components such as a speaker and/or a microphone if desired.

Display 14 may include a display module having conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 16 and 20, openings may be formed within the conductive structures of device 10 (e.g., between peripheral conductive housing structures 12W and opposing conductive ground structures such as conductive portions of conductive rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 16 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 16. If desired, the ground plane that is under active area AA of display 14 and/or other metal structures in device 10 may have portions that extend into parts of the ends of device 10 (e.g., the ground may extend towards the dielectric-filled openings in regions 20 and 16), thereby narrowing the slots in regions 20 and 16.

In general, device 10 may include any suitable number of antennas (e.g., one or more, two or more, three or more, four or more, etc.). The antennas in device 10 may be located at opposing first and second ends of an elongated device housing (e.g., at ends within regions 20 and 16 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. There may be, for example, two peripheral conductive segments in peripheral conductive housing structures 12W (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of peripheral conductive housing structures 12W that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 12W and may form antenna slots, gaps 18, and other structures in device 10. Polymer or other dielectric may fill these grooves and other housing openings. In some situations, housing openings that form antenna slots and other structures may be filled with a dielectric such as air.

In a typical scenario, device 10 may have one or more upper antennas and one or more lower antennas (as an example). An upper antenna may, for example, be formed at the upper end of device 10 in region 16. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area of regions 20 and 16 that is available for forming antennas within device 10. In general, antennas that are provided with larger operating volumes or spaces may have higher bandwidth efficiency than antennas that are provided with smaller operating volumes or spaces. If care is not taken, increasing the size of active area AA may reduce the operating space available to the antennas, which can undesirably inhibit the efficiency bandwidth of the antennas (e.g., such that the antennas no longer exhibit satisfactory radio-frequency performance). It would therefore be desirable to be able to provide antennas that occupy a small amount of space within device 10 (e.g., to allow for as large of a display active area AA as possible) while still allowing the antennas to operate with optimal efficiency bandwidth.

Figure 2:
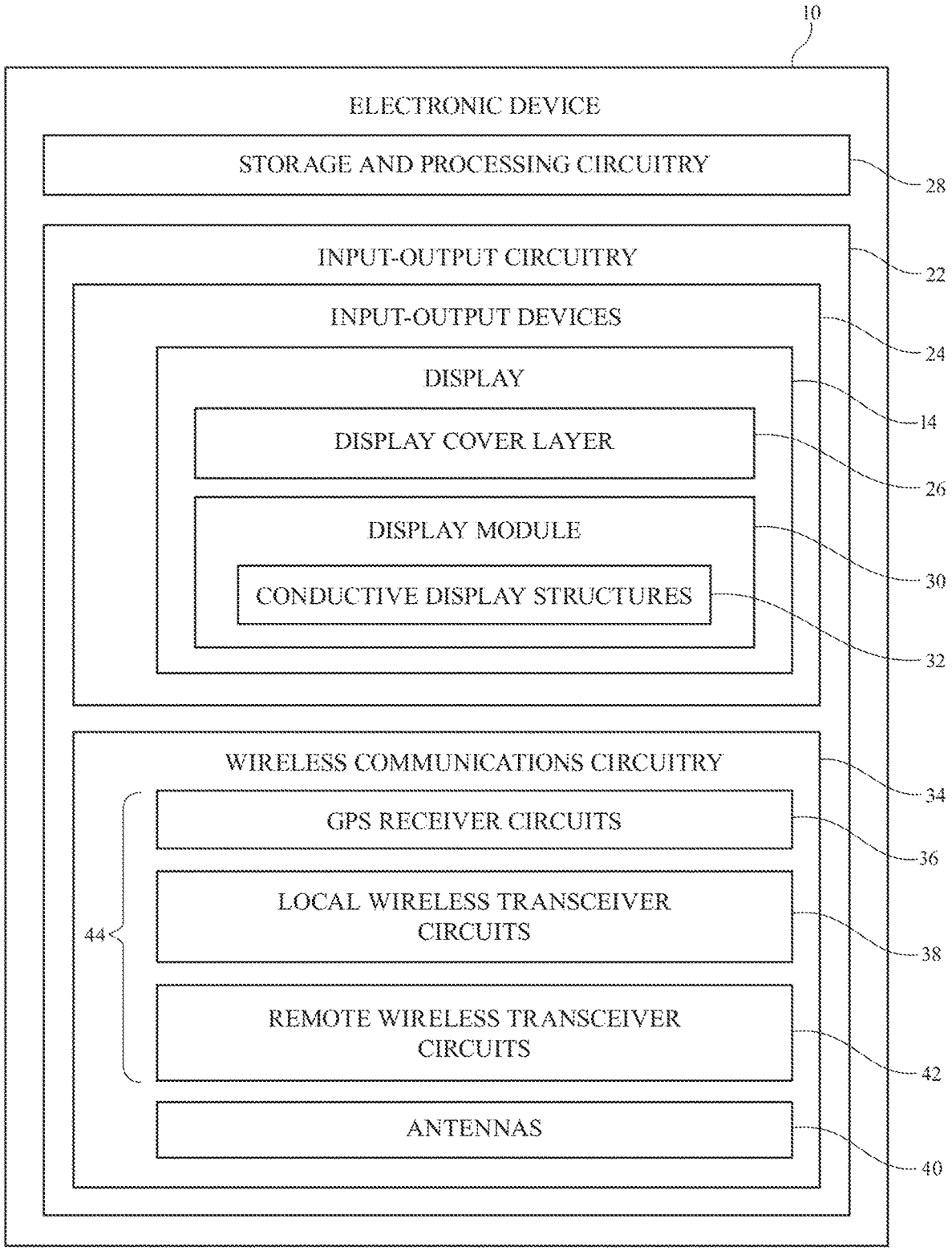
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as Wi-Fi®), protocols for other short-range wireless communications links such as the Bluetooth® protocol or other wireless personal area network protocols, cellular telephone protocols, multiple-input and multiple-output (MIMO) protocols, antenna diversity protocols, near-field communications (NFC) protocols, etc.

Input-output circuitry 22 may include input-output devices 24. Input-output devices 24 may be used to allow data to be supplied to device 10 and to allow data to be provided from device 10 to external devices. Input-output devices 24 may include user interface devices, data port devices, and other input-output components.

Input-output devices 24 may include display components such as display 14. Display 14 may include a display cover layer such as display cover layer 26 and a display module such as display module 30. Display module 30 may include active circuitry such as pixel circuitry, touch sensor circuitry, and/or force sensor circuitry. Display cover layer 26 may overlap display module 30. Display module 30 may emit image light through display cover layer 26 and may receive user input through display cover layer 26. Display module 30 may, for example, form active area AA of display 14 (FIG. 1).

Display module 30 may include conductive display structures such as conductive display structures 32. Conductive display structures 32 may include a conductive frame for the active components of display module 30, conductive layers in the display module (e.g., a conductive backplate for the display module or conductive layers embedded within the dielectric layers of the display module), conductive shielding structures, ground layers in display module 30, and/or other conductive structures in display module 30. If desired, conductive display structures 32 may include portions of the pixel circuitry, touch sensor circuitry, force sensor circuitry, and/or other components in display module 30. Conductive display structures 32 may include conductive portions of display 14 that are not a part of display module 30 if desired. Conductive display structures 32 may laterally extend across active area AA of FIG. 1. As active area AA of display 14 is maximized, the space within device 10 occupied by display module 30 and conductive display structures 32 is also maximized, thereby limiting the amount of space available within device 10 for forming other component such as antennas.

Input-output devices 24 of FIG. 2 may include other input-output components. For example, input-output devices 24 may include buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors (e.g., a fingerprint sensor integrated with a button), etc.

Input-output circuitry 22 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 44 for handling various radio-frequency communications bands. For example, circuitry 34 may include transceiver circuitry 36, 38, and 42. Transceiver circuitry 38 may handle wireless local area network (WLAN) bands such as 2.4 GHz and 5 GHz bands for Wi-Fi® (IEEE 802.11) communications and/or wireless personal area network (WPAN) bands such as the 2.4 GHz Bluetooth® communications band. Circuitry 34 may use remote wireless transceiver circuitry 42 such as cellular telephone transceiver circuitry for handling wireless communications in frequency ranges such as a low communications band from 700 to 960 MHz, a low-midband from 960 to 1710 MHz, a midband from 1710 to 2170 MHz, a high band from 2300 to 2700 MHz, an ultra-high band from 3400 to 3700 MHz, or other communications bands between 600 MHz and 4000 MHz or other suitable frequencies (as examples).

Circuitry 42 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include satellite navigation receive equipment such as global positioning system (GPS) receiver circuitry 36 for receiving GPS signals at 1575 MHz or for handling other satellite positioning data (e.g., Global Navigation Satellite System (GLONASS) signals, etc.). In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
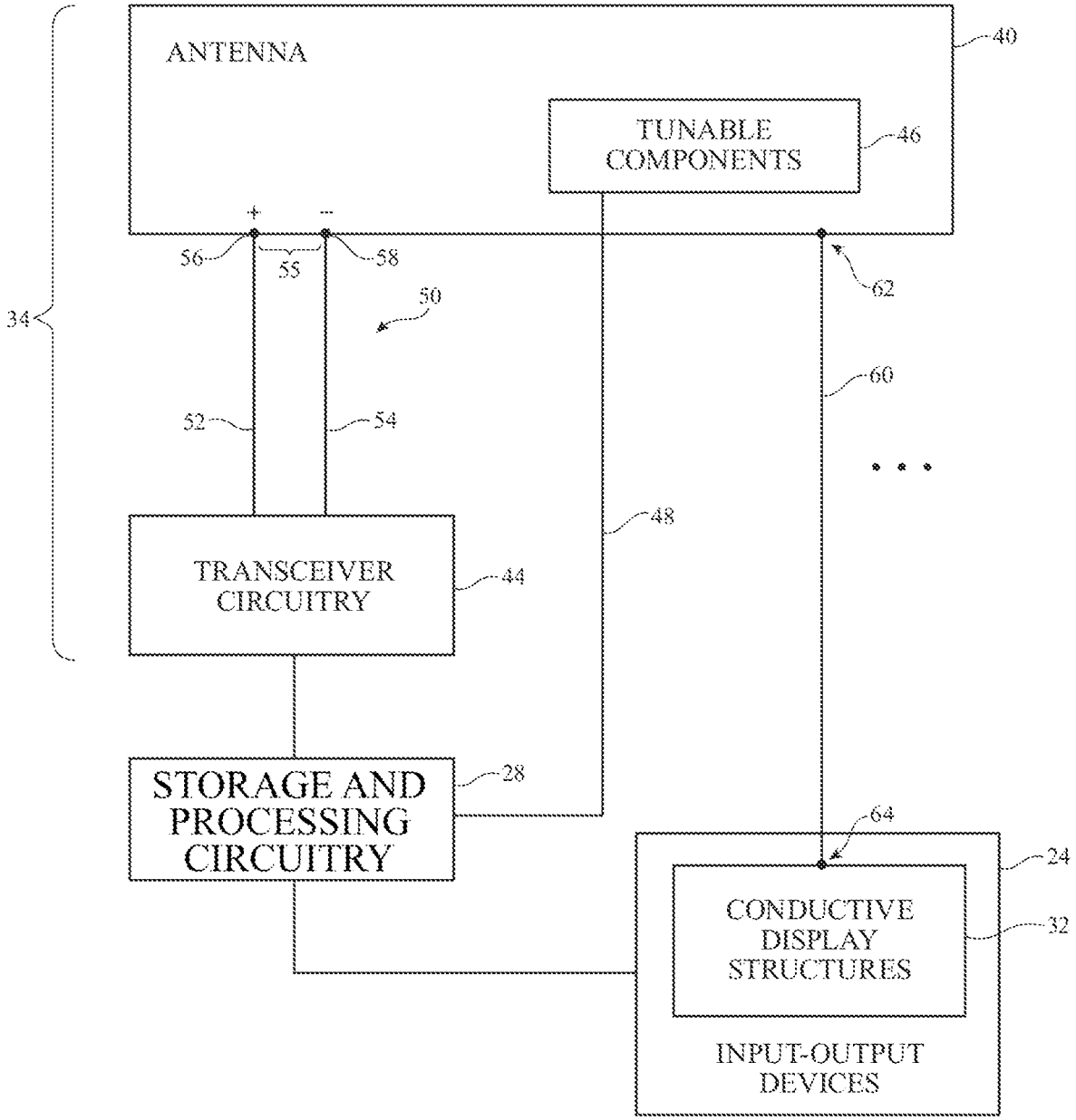
FIG. 3 is a schematic diagram of illustrative wireless communications circuitry in accordance with an embodiment.

As shown in FIG. 3, transceiver circuitry 44 in wireless communications circuitry 34 may be coupled to a given antenna 40 using paths such as path 50. Wireless communications circuitry 34 may be coupled to storage and processing circuitry 28. Storage and processing circuitry 28 may be coupled to input-output devices 24. Input-output devices 24 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 46 to tune the antenna over communications bands of interest. Tunable components 46 may be part of a tunable filter or tunable impedance matching network, may be part of an antenna resonating element, may span a gap between an antenna resonating element and antenna ground, etc.

Tunable components 46 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, storage and processing circuitry 28 may issue control signals on one or more paths such as path 48 that adjust inductance values, capacitance values, or other parameters associated with tunable components 46, thereby tuning antenna 40 to cover desired communications bands.

Path 50 may include one or more transmission lines. As an example, path 50 of FIG. 3 may be a radio-frequency transmission line having a positive signal conductor such as conductor 52 and a ground signal conductor such as conductor 54. Transmission line structures used to form path 50 (sometimes referred to herein as transmission lines 50 or radio-frequency transmission lines 50) may include parts of a coaxial cable, a stripline transmission line, microstrip transmission line, coaxial probes realized by metalized vias, edge-coupled microstrip transmission lines, edge-coupled stripline transmission lines, waveguide structures, transmission lines formed from combinations of transmission lines of these types, etc.

Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 46) may include components such as inductors, resistors, and capacitors used in matching the impedance of antenna 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna 40 and may be tunable and/or fixed components.

Transmission line 50 may be coupled to antenna feed structures associated with antenna 40. As an example, antenna 40 may form an inverted-F antenna, a slot antenna, a hybrid inverted-F slot antenna or other antenna having an antenna feed 55 with a positive antenna feed terminal such as terminal 56 and a ground antenna feed terminal such as terminal 58. Positive transmission line conductor 52 may be coupled to positive antenna feed terminal 56 and ground transmission line conductor 54 may be coupled to ground antenna feed terminal 58. Other types of antenna feed arrangements may be used if desired. For example, antenna 40 may be fed using multiple feeds (e.g., switchable feeds where a selected feed may be switched into use at any given time). The illustrative feeding configuration of FIG. 3 is merely illustrative. In scenarios where electronic device 10 includes multiple antennas 40, each antenna 40 may include its own antenna feed 55 and a corresponding transmission line 50, for example.

Storage and processing circuitry 28 may use information from a proximity sensor, wireless performance metric data such as received signal strength information, device orientation information from an orientation sensor, device motion data from an accelerometer or other motion detecting sensor, information about a usage scenario of device 10, information about whether audio is being played through a speaker, information from one or more antenna impedance sensors, and/or other information in determining when antenna 40 is being affected by the presence of nearby external objects or is otherwise in need of tuning. In response, storage and processing circuitry 28 may adjust an adjustable inductor, adjustable capacitor, switch, or other tunable component 46 and/or may switch one or more antennas 40 into or out of use to ensure that wireless communications circuitry 34 operates as desired.

The presence or absence of external objects such as a user's hand may affect antenna loading and therefore antenna performance. Antenna loading may differ depending on the way in which device 10 is being held. For example, antenna loading and therefore antenna performance may be affected in one way when a user is holding device 10 in a portrait orientation and may be affected in another way when a user is holding device 10 in a landscape orientation. To accommodate various loading scenarios, device 10 may use sensor data, antenna measurements, information about the usage scenario or operating state of device 10, and/or other data from input-output devices 24 to monitor for the presence of antenna loading (e.g., the presence of a user's hand, the user's head, or another external object). Device 10 (e.g., storage and processing circuitry 28) may then adjust tunable components 46 in antenna 40 and/or may switch other antennas into or out of use to compensate for the loading (e.g., multiple antennas 40 may be operated using a diversity protocol to ensure that at least one antenna 40 may maintain satisfactory communications even while the other antennas are blocked by external objects).

In the example of FIG. 3, a single antenna is shown. When operating using a single antenna, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna may not be capable of providing sufficient data throughput for handling the desired device operations. In order to increase the overall data throughput of wireless communications circuitry 34, multiple antennas 40 may be operated using a multiple-input and multiple-output (MIMO) scheme. When operating using a MIMO scheme, two or more antennas on device 10 may be used to convey multiple independent streams of wireless data at the same frequencies. This may significantly increase the overall data throughput between device 10 and the external communications equipment relative to scenarios where only a single antenna is used. In general, the greater the number of antennas that are used for conveying wireless data under the MIMO scheme, the greater the overall throughput of circuitry 34.

The radio-frequency performance of antenna 40 may be influenced by the presence of conductive structures in the vicinity of antenna 40. For example, the presence of conductive display structures 32 in the vicinity of antenna 40 can block or otherwise deteriorate the radio-frequency performance of antenna 40 in one or more directions (e.g., a direction through display 14 of FIG. 1). Conductive display structures 32 may have a particularly strong effect on the radio-frequency performance of antenna 40 as active area AA of display 14 (FIG. 1) is increased, thereby minimizing the volume available for forming antennas 40.

In order to minimize the electromagnetic influence of conductive display structures 32 on the radio-frequency performance of antenna 40, one or more conductive bridging structures 60 may be used to electrically couple (e.g., ground) conductive display structures 32 to antenna 40. For example, each bridging structure 60 may have a first terminal 62 coupled to antenna 40 and a second terminal 64 coupled to conductive display structures 32.

Bridging structures 60 (sometimes referred to herein as conductive structures 60, conductive bridging structures 60, conductive grounding structures 60, or grounding structures 60) may include conductive tape (e.g., a layer of copper, gold, or other metals provided with a layer of pressure sensitive adhesive on one or both faces), conductive foam, a conductive gasket (e.g., an air loop gasket), other conductive adhesives, conductive wire, sheet metal, conductive wire, conductive springs, solder, welds, conductive traces on an underlying substrate, conductive pins, combinations of these, and/or any other desired conductive structures. In scenarios where bridging structures 60 include conductive tape, the conductive tape may have an end that is wrapped (folded) around a layer of heat-activated film.

Operation of antenna 40 may induce current on conductive display structures 32. Some current may leak across bridging structures 60 so that currents in the conductive structures of antenna 40 are in phase with the currents induced by antenna 40 on conductive display structures 32. This may ground conductive display structures 32 (e.g., by coupling conductive display structures 32 to a ground potential through the conductive structures in antenna 40) and may serve to minimize the electromagnetic impact of conductive display structures 32 on the radio-frequency signals handled by antenna 40.

Figure 4:
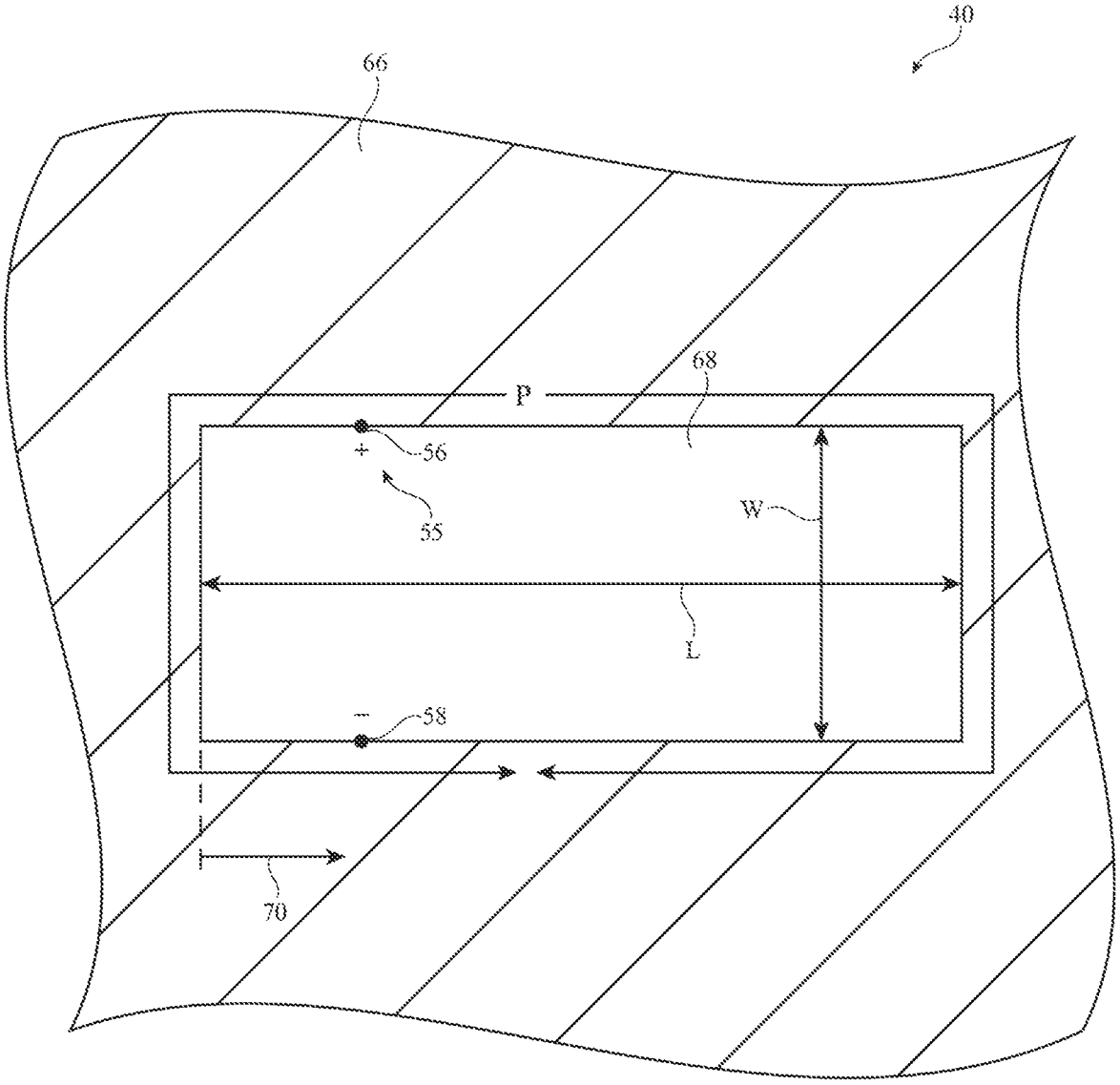
FIG. 4 is a diagram of illustrative slot antenna structures in accordance with an embodiment.

An illustrative slot antenna structure that may be used for forming antenna 40 is shown in FIG. 4. As shown in FIG. 4, antenna 40 may include a conductive structure such as conductive structure 66 that has been provided with a dielectric-filled opening such as dielectric opening 68.

Openings such as opening 68 of FIG. 4 are sometimes referred to as slots, slot elements, slot radiating elements, slot resonating elements, or slot antenna resonating elements of antenna 40. In the configuration of FIG. 4, slot 68 is a closed slot, because portions of conductive structure 66 completely surround and enclose slot 68. Open slot antenna structures may also be formed in conductive materials such as conductive structure 66 (e.g., by forming an opening in the right-hand or left-hand end of conductive structure 66 so that slot 68 protrudes through conductive structure 66).

Antenna feed 55 for antenna 40 may be formed using positive antenna feed terminal 56 and ground antenna feed terminal 58. In general, the frequency response of an antenna is related to the size and shapes of the conductive structures in the antenna. Slot antenna structures of the type shown in FIG. 4 tend to exhibit response peaks when slot perimeter P is equal to the wavelength of operation of the antenna (e.g. where perimeter P is equal to two times length L plus two times width W). Antenna currents may flow between antenna feed terminals 56 and 58 around perimeter P of slot 68.

Antenna feed 55 may be coupled across slot 68 at a location along elongated length L. For example, antenna feed 55 may be located at a distance 70 from one side of slot 68. Distance 70 may be adjusted to match the impedance of antenna 40 to the impedance of the corresponding transmission line (e.g., transmission line 50 of FIG. 3). For example, the antenna current flowing around slot 68 may experience an impedance of zero at the left and right edges of slot 68 (e.g., a short circuit impedance) and an infinite (open circuit) impedance at the center of slot 68 (e.g., at a fundamental frequency of the slot). Antenna feed 55 may be located between the center of slot 68 and the left edge at a location where the antenna current experiences an impedance that matches the impedance of the corresponding transmission line (e.g., distance 70 may be between 0 and ¼ of the wavelength of operation of antenna structures 40). Distance 70 may, for example, be 9 mm, between 5 mm and 10 mm, between 2 mm and 12 mm, or any other suitable distance. Slot 68 may have a width W perpendicular to length L.

In scenarios where slot 68 is a closed slot, length L may be approximately equal to (e.g., within 15% of) one-half of a wavelength of operation of the antenna (e.g., a wavelength of a fundamental mode of the antenna). Harmonic modes of slot 68 may also be configured to cover desired frequency bands. In scenarios where slot 68 is an open slot, length L may be approximately equal to one-quarter of the wavelength of operation. The wavelength of operation may, for example, be an effective wavelength of operation based on the dielectric material within slot 68.

The frequency response of slot 68 can be tuned using one or more tuning components (e.g., tunable components 46 of FIG. 3). These components may have terminals that are coupled to opposing sides of slot 68 (i.e., the tunable components may bridge the slot). If desired, tunable components may have terminals that are coupled to respective locations along the length of one of the sides of slot 68. Combinations of these arrangements may also be used. Antenna 40 may sometimes be referred to herein as slot antenna 40.

The example of FIG. 4 is merely illustrative. In general, slot 68 may have any desired shape (e.g., where the perimeter P of slot 68 defines radiating characteristics of the antenna). For example, slot 68 may have a meandering shape with different segments extending in different directions, may have straight and/or curved edges, may have more than one open end, etc. Conductive structure 66 may be formed from any desired conductive electronic device structures. For example, conductive structure 66 may include conductive traces on printed circuit boards or other substrates, sheet metal, metal foil, conductive structures associated with display 14 (FIG. 1), conductive portions of housing 12 (e.g., conductive structures 12W and/or 12R of FIG. 1), and/or other conductive structures within device 10. If desired, different sides (edges) of slot 68 may be defined by different conductive structures. In one suitable arrangement that is sometimes described herein as an example, one side of slot 68 may be formed from peripheral conductive structures 12W (FIG. 1) whereas the other side of slot 68 is formed from conductive rear housing wall 12R.

Figure 5:
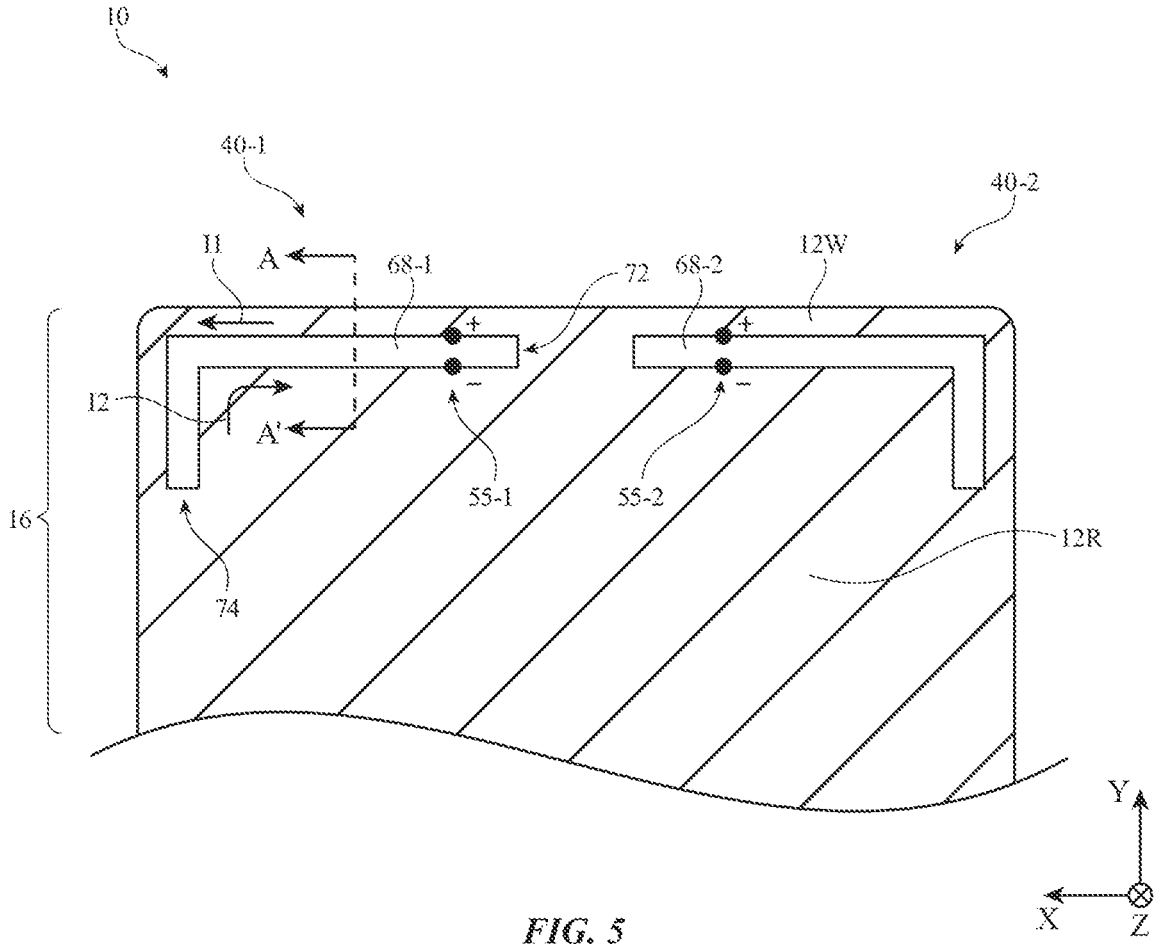
FIG. 5 is a rear view of an illustrative electronic device having slot antennas formed from conductive housing structures in accordance with an embodiment.

FIG. 5 is a rear view of region 16 at the upper end of device 10. As shown in FIG. 5, multiple antennas 40 such as a first antenna 40-1 and a second antenna 40-2 may be formed within region 16. Each antenna may include a corresponding slot 68 that is fed using a corresponding antenna feed 55. In the example of FIG. 5, antenna 40-1 includes slot 68-1 that is fed using antenna feed 55-1. Antenna 40-2 includes slot 68-2 that is fed using antenna feed 55-2. Slot 68-1 may be fed using antenna feed 55-1 at any desired location between edges (ends) 74 and 72 (e.g., at any desired location along the elongated length of slot 68-1). The locations of the positive and ground antenna feed terminals in antenna feed 55-1 may be swapped if desired. Similarly, slot 68-2 may be feed using antenna feed 55-2 at any location along its length and the positive and ground antenna feed terminals in antenna feed 55-2 may be swapped if desired.

As shown in FIG. 5, slots 68-1 and 68-2 each have a first edge (side) defined by peripheral conductive housing structures 12W and an opposing second edge (side) defined by conductive rear housing wall 12R. Slots 68-1 and 68-2 may be filled with dielectric material (e.g., dielectric material that lies flush with the rear exterior surface of device 10). Slots 68-1 and 68-2 may be covered by a dielectric cover layer (not shown) that obscures slots 68-1 and 68-2 from view if desired. Slots 68-1 and 68-2 may each include perpendicular portions to allow antennas 40-1 and 40-2 to cover relatively low frequencies while still fitting within the rear face of device 10. In scenarios where slots 68-1 and 68-2 are open slots, one or both ends of each slot (e.g., end 74 of slot 68-1) may be continuous with a corresponding gap 18 (FIG. 1) in peripheral conductive housing structures 12W.

Antennas 40-1 and 40-2 may both cover the same radio-frequency communications bands if desired. For example, antennas 40-1 and 40-2 may both convey radio-frequency signals in one or more wireless local area network bands. A given one of antennas 40-1 and 40-2 may be switched into use at a given time (e.g., using an antenna diversity scheme) or both antennas 40-1 and 40-2 may be active at a given time (e.g., using a MIMO scheme). While the structures of antenna 40-1 are described in greater detail herein as an example, similar structures may also be used to form antenna 40-2 and/or any other desired antennas within device 10.

As shown in FIG. 5, radio-frequency signals conveyed over antenna feed 55-1 may produce antenna currents I1 and I2 running around the periphery of slot 68-1. Antenna currents I1 and I2 may generate corresponding radio-frequency signals that are radiated by antenna 40-1. Similarly, radio-frequency signals received by antenna 40-1 may generate antenna currents I1 and I2 that are conveyed to transceiver circuitry 44 (FIG. 3) over antenna feed 55-1. The length of slot 68-1 (e.g., from end 74 to end 72) may define the frequencies of operation for antenna 40. Radio-frequency signals conveyed by antenna 40 may propagate freely through the rear face of device 10 (e.g., due to the absence of other conductive structures over the rear face of device 10 within region 16). However, if care is not taken, conductive display structures 32 in display 14 (FIG. 2) may block radio-frequency signals conveyed by antenna 40 from propagating freely through the front face of device 10.

Figure 6:
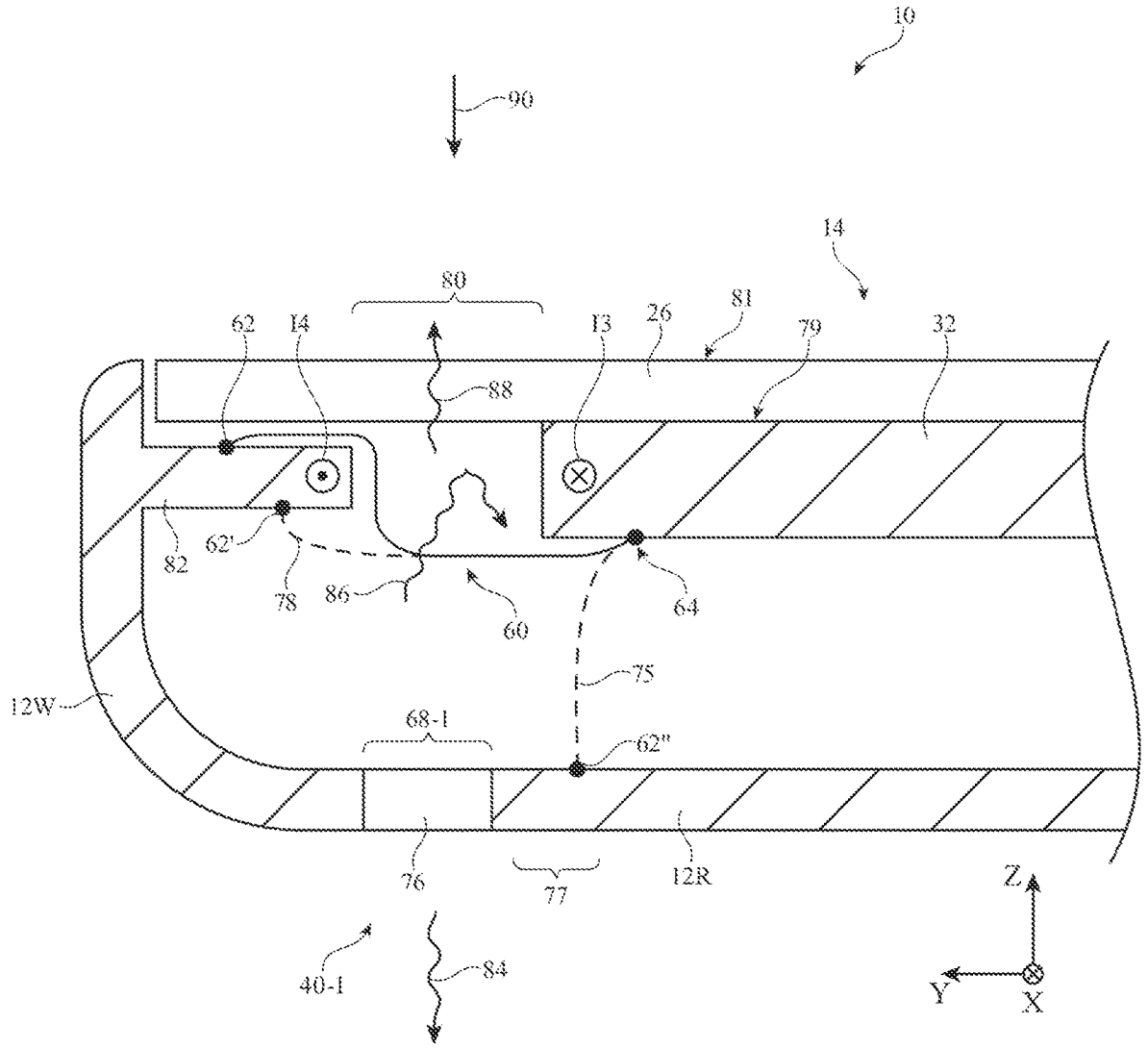
FIG. 6 is a cross-sectional side view showing how illustrative conductive bridging structures may overlap a slot antenna to optimize radio-frequency performance through a display in accordance with an embodiment.

FIG. 6 is a cross-sectional side view of device 10 (e.g., as taken along line AA' of FIG. 5) showing how bridging structure 60 (FIG. 3) may be used to optimize the radio-frequency performance of antenna 40-1 through display 14. As shown in FIG. 6, display cover layer 26 may be mounted over conductive structures 32 in display 14. Display cover layer 26 may be transparent and may be formed from any desired materials such as glass, plastic, or sapphire. Portions of display cover layer 26 may be provided with an opaque masking layer such as an ink layer if desired.

Display 14 may be mounted to peripheral conductive housing structures 12W. Peripheral conductive housing structures 12W may be separated from conductive rear housing wall 12R by slot 68-1 in antenna 40-1. Dielectric material such as dielectric 76 (e.g., plastic, ceramic, glass, or other dielectric material) may be placed within slot 68-1 and may lie flush with the outer surface of conductive rear housing wall 12R. If desired, a dielectric cover layer such as a glass or ceramic layer (not shown) may cover the outer surfaces of conductive rear housing wall 12R and dielectric 76. In this way, peripheral conductive housing structures 12W and conductive rear housing wall 12R may define opposing sides of slot 68-1 for antenna 40-1.

Peripheral conductive housing structures 12W may have an inwardly-protruding portion (extension) 82 that is sometimes referred to herein as ledge 82 or datum 82. Ledge 82 may have a lateral surface that extends parallel to inner surface 79 of display cover layer 26. Display 14 may be secured to peripheral conductive housing structures 12W by attaching (affixing) display cover layer 26 to ledge 82 using adhesive material.

Conductive display structures 32 may be separated from ledge 82 by gap 80. Antenna 40 may transmit and receive radio-frequency signals through the rear face of device 10, as shown by arrow 84. In scenarios where gap 80 is suitably large, antenna 40 may freely transmit and receive radio-frequency signals through gap 80. However, as the size of gap 80 is reduced (e.g., to maximize active area AA for display 14 as shown in FIG. 1), the presence of conductive display structures 32 in the vicinity of slot 68-1 can serve to block radio-frequency signals from passing freely through gap 80, as shown by arrow 86. For example, radio-frequency signals generated by antenna 40 may induce current I4 on ledge 82 and an opposing current I3 on conductive display structures 32. In the absence of grounding (bridging) structures for display 14, current I3 may be out of phase with current I4 at one or more locations along the length of slot 68-1. This may cause current I3 to cancel out at least some of current I4 on ledge 82, which serves to deteriorate the efficiency and bandwidth of antenna 40 through the front face of device 10 (e.g., through gap 80 and display 14).

To minimize these effects and maximize antenna efficiency through gap 80, bridging structure 60 may be coupled between peripheral conductive housing structures 12W and conductive display structures 32 across gap 80. For example, as shown in FIG. 6, bridging structure 60 may have a first terminal 62 coupled to ledge 82 and a second terminal 64 coupled to conductive display structures 32. Some of the current produced by antenna 40 may pass between ledge 82 and conductive display structures 32 over bridging structure 60, allowing current I3 on conductive display structures 32 to be in phase with current I4 on ledge 82. This may serve to minimize the electromagnetic impact of conductive display structures 32 on the radio-frequency signals handled by antenna 40, and may allow antenna 40 to convey the radio-frequency signals through gap 80 with maximum efficiency and bandwidth, as shown by arrow 88.

In the example of FIG. 6, bridging structure 60 is coupled to an upper surface of ledge 82 (e.g., terminal 62 and a portion of bridging structure 60 may be interposed between ledge 82 and display cover layer 26). In this scenario, bridging structure 60 may include adhesive that helps to secure display cover layer 26 to ledge 82. For example, the end of bridging structure 60 that includes terminal 62 may include conductive tape that is folded around a layer of heat-activated film. During assembly of display 14 to peripheral conductive housing structures 12W, the heat-activated film may be heated and pressed down until exterior surface 81 of display cover layer 26 lies flush with the top surface of peripheral conductive housing structures 12W. When cooled, the heat-activated film may hold display cover layer 26 in place while the conductive material in the conductive tape electrically couples ledge 82 to conductive display structures 32. In this way, bridging structure 60 may be used both to electrically couple ledge 82 to conductive display structures 32 and to help adhere display cover layer 26 to peripheral conductive housing structures 12W.

This example is merely illustrative. In general, bridging structure 60 may be coupled to any desired location on peripheral conductive housing structures 12W. As another example, bridging structure 60 may be coupled to the bottom surface of ledge 82, as shown by terminal 62' and path 78. In this scenario, bridging structure 60 may be formed from conductive foam or a conductive gasket that exerts a force upwards onto terminals 64 and 62' (e.g., to help maintain reliable mechanical contact between the bridging structure, ledge 82, and conductive display structures 32). Bridging structure 60 may include any other desired conductive structures that serve to align the phases of currents I4 and I3. As yet another example, bridging structure 60 may be coupled to conductive rear housing wall 12R within an inner region 77 located adjacent to (e.g., to the right of) slot 68-1, as shown by terminal 62" and path 75. Region 77 may, for example, lie within a few millimeters of the edge of slot 68-1 (e.g., terminal 62" may be offset with respect to slot 68-1 on conductive rear housing wall 12R). In one suitable arrangement, region 77 and/or terminal 62" may lie directly beneath terminal 64. In scenarios where bridging structure 60 follows path 75, bridging structure 60 may be formed from a conductive air loop gasket, a conductive clip (e.g., a clip that clips into an attachment structure at terminal 64), conductive springs, conductive pins, conductive adhesive, solder, and/or any other desired conductive structures.

Conductive bridging structures such as bridging structure 60 of FIG. 6 may bridge gap 80 at one or more desired locations over slot 68-1 (e.g., bridging structures such as bridging structure 60 may overlap one or more portions of slot 68-1). Each bridging structure may be coupled to ledge 82 (e.g., at terminals such as terminals 62' or 62), may each be coupled to conductive rear housing wall 12R (e.g., at terminals such as terminal 62"), or different bridging structures may be coupled to different portions of housing 12 (e.g., some of the conductive bridging structures may be coupled to ledge 82 whereas other conductive bridging structures are coupled to conductive rear housing wall 12R). Bridging gap 80 at multiple locations may, for example, allow the phase of current I4 to be aligned with the phase of current I3 across the entire length of slot 68-1. However, care should be taken when placing the bridging structures over slot 68-1. For example, if there are an excessive number of bridging structures overlapping slot 68-1, the bridging structures, which include conductive material, may block radio-frequency signals from passing through gap 80 (e.g., efficiency losses from blocking may outweigh gains in efficiency due to aligning the phases of currents I3 and I4). In order to balance these factors to optimize antenna efficiency through gap 80, bridging structures may be formed over slot 68-1 using an arrangement such as the arrangement shown in FIG. 7.

Figure 7:
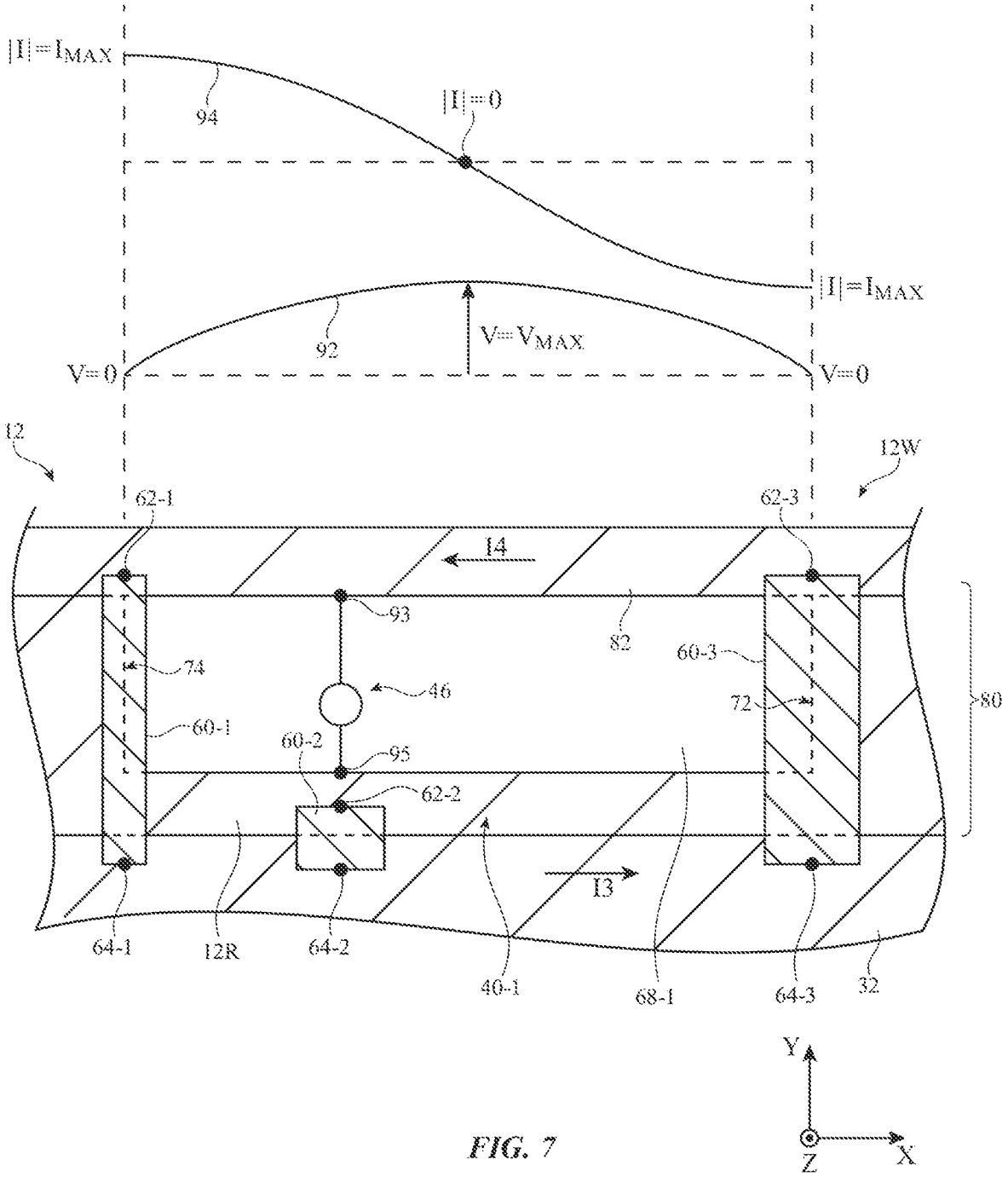
FIG. 7 is a top-down view showing how illustrative bridging structures may overlap different locations along the length of a slot antenna in accordance with an embodiment.

FIG. 7 is a top-down view of antenna 40 (e.g., as taken in the direction of arrow 90 of FIG. 6) showing how multiple bridging structures may be used to bridge gap 80. In the example of FIG. 7, display cover layer 26 (FIG. 6) has been omitted, antenna feed 55-1 (FIG. 5) has been omitted, and slot 68-1 is shown with a rectangular shape for the sake of clarity. In general, slot 68-1 may have any other desired shape (e.g., an L-shape as shown in FIG. 5).

As shown in FIG. 7, slot 68-1 may have opposing first and second edges defined by peripheral conductive housing structures 12W and conductive rear housing wall 12R. The length of slot 68-1 between third and fourth edges 72 and 74 may define the radiating frequencies for antenna 40-1. For example, the length of slot 68-1 between edges 74 and 72 may be approximately one-half of the wavelength of operation for antenna 40-1. When antenna 40-1 is active, current I4 may be induced in peripheral conductive housing structures 12W whereas current I3 is induced in conductive display structures 32. Conductive display structures 32 may be laterally offset from the outline of slot 68-1 (as shown in FIG. 7) or may partially overlap the lateral outline of slot 68-1.

Curve 92 of FIG. 7 illustrates the voltage V across the width of slot 68-1 at different points between edges 74 and 72. As shown by curve 92, voltage V is maximum (e.g., $V=V_{MAX}$) at the center of slot 68-1. Voltage V is equal to zero at edges 74 and 72 (e.g., due to the short circuit impedance between rear housing wall 12R and peripheral conductive housing structures 12W).

Curve 94 illustrates the current I across the width of slot 68-1 at different points between edges 74 and 72. As shown by curve 94, current I across slot 68-1 is maximum (i.e., has a maximum magnitude $|I|=I_{MAX}$) at edges 74 and 72. Current I may exhibit a minimum magnitude at the center of slot 68-1.

Multiple bridging structures 60 such as a first bridging structure 60-1, a second bridging structure 60-2, and a third bridging structure 60-3 may be coupled between conductive display structures 32 and housing 12 (e.g., to either peripheral conductive housing structures 12W across gap 80 or to rear housing wall 12R beneath conductive structures 32). Each of the bridging structures coupled to peripheral conductive housing structures 12W may at least partially overlap the underlying slot 68-1. Bridging structures 60-1 and 60-3 may be coupled to peripheral conductive housing structures 12W at respective terminals 62-1 and 62-3. Bridging structure 60-2 may be coupled to rear housing wall 12R at terminal 62-2 (e.g., at terminal 62" of FIG. 6). As shown in FIG. 7, bridging structures 60-1, 60-2, and 60-3 may be coupled to conductive display structures 32 at respective terminals 64-1, 64-2, and 64-3.

Bridging structures 60-1, 60-2, and 60-3 may have any desired width (e.g., parallel to the X-axis of FIG. 7). Bridging structures 60-1, 60-2, and 60-3 may each have the same width or two or more of these structures may have different widths. In the example of FIG. 7, bridging structures 60-2 and 60-3 are shown as having a greater width than bridging structure 60-1. This is merely illustrative. In general, greater widths may allow the bridging structure to include more conductive adhesive that provides greater adhesion for display cover layer 26 (FIG. 6) than thinner widths. At the same time, thinner widths may block fewer radio-frequency signals from propagating through gap 80 (e.g., parallel to the Z-axis) than greater widths.

In order to ensure that current I4 is in phase with current I3 (and thus that antenna 40 exhibits maximum efficiency through gap 80), the bridging structures may overlap slot 68 at locations where the magnitude of current I is maximum. In the example of FIG. 7, bridging structure 60-1 overlaps edge 74 and bridging structure 60-3 overlaps edge 72 of slot 68-1, where current I exhibits maximum magnitude $I_{MAX}$. In general, bridging structure 60-1 may at least partially overlap edge 74 (e.g., the entire width of bridging structure 60-1 may overlap slot 68-1 at edge 74, part of the width of bridging structure 60-1 may overlap the conductive material defining edge 74 whereas part of the width overlaps slot 68-1, or the entire width of bridging structure 60-1 may overlap the conductive material defining edge 74). Similarly, bridging structure 60-3 may at least partially overlap edge 72 (e.g., the entire width of bridging structure 60-3 may overlap slot 68-1 at edge 72, part of the width of bridging structure 60-3 may overlap the conductive material defining edge 72 whereas part of the width overlaps slot 68-1, or the entire width of bridging structure 60-3 may overlap the conductive material defining edge 72). Locating bridging structures 60-1 and 60-3 in this way may ensure that the bridging structures align the phases of currents I4 and I3 where currents I4 and I3 are most likely to exhibit a maximum magnitude, thereby resulting in a maximum increase in antenna efficiency through gap 80.

In the example of FIG. 7, a tuning component such as tuning component 46 is coupled across the width of slot 68-1. The impedance provided across slot 68-1 by tuning component 46 may alter the current across slot 68-1 such that induced currents I4 and current I3 may be slightly out of phase over the location of tuning component 46. Bridging structure 60-2 may be aligned with tuning component 46 (relative to the length of slot 68-1) to align the phases of currents I4 and I3 at this location to further optimize antenna efficiency through gap 80. Bridging structure 60-2 may be aligned with some or all of tuning component 46 (e.g., structure 60-2 may be aligned with terminal 95 of tuning component 46, terminal 93 of tuning component 46, and/or may be aligned with the active/passive circuitry within tuning component 46).

If desired, bridging structures 60 that overlap edges 74 and 72 of slot 68-1 such as bridging structures 60-1 and 60-3 of FIG. 7 may be coupled to ledge 82 of peripheral conductive housing structures 12W (e.g., at terminals 62 and/or 62' of FIG. 6) whereas bridging structures 60 that are aligned with tuning components 46 such as bridging structure 60-2 may be coupled to rear housing wall 12R (e.g., at terminal 62" of FIG. 6).

In general, bridging structures 60 may overlap slot 68-1 (e.g., may be coupled to peripheral conductive housing structures 12W) and/or may be coupled to rear housing wall 12R (e.g., without overlapping slot 68-1) at any locations along the length of slot 68-1 where current I exhibits a maximum magnitude and at any locations along the length of slot 68-1 where tuning components such as tuning components 46 are formed. Bridging structures 60 may overlap locations along the length of slot 68-1 where current I exhibits a global maximum (e.g., edges 72 and 74) and/or a local maximum (e.g., due to harmonic modes of slot 68-1). In this way, bridging structures 60 may serve to align the phases of currents I3 and I4 along the entire length of slot 68-1 (thereby maximizing antenna efficiency) without significantly blocking radio-frequency signals from passing through gap 80.

The example of FIG. 7 is merely illustrative. Bridging structures 60 need not overlap every location where slot 68-1 exhibits a maximum current and need not overlap every location where tuning components are formed. One or more of bridging structures 60-1, 60-2, and 60-3 of FIG. 7 may be omitted if desired. Bridging structures 60 may overlap other portions of slot 68-1 if desired.

Figure 8:
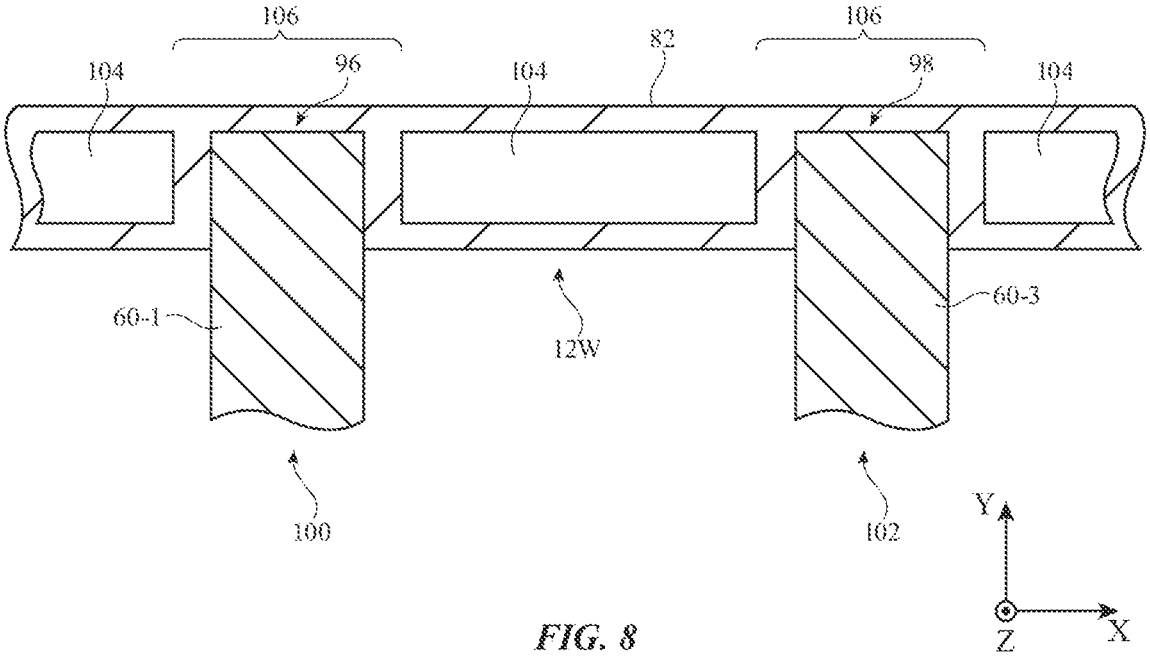
FIG. 8 is a top-down view of illustrative bridging structures coupled to a conductive housing wall within gaps in a layer of pressure-sensitive adhesive in accordance with an embodiment.

The ends of bridging structures 60-1, 60-2, and/or 60-3 may, if desired, include adhesive material that is used to help attach display cover layer 26 (FIG. 6) to peripheral conductive housing structures 12W. Additional adhesive material such as pressure sensitive adhesive may be used to help secure display cover layer 26 to peripheral conductive housing structures 12W. FIG. 8 is a top-down view (e.g., as taken in the direction of arrow 90 of FIG. 6) showing how two conductive bridging structures such as conductive bridging structures 60-1 and 60-3 of FIG. 7 may be used to help secure display cover layer 26 (FIG. 6) to peripheral conductive housing structures 12W. In the example of FIG. 8, display cover layer 26 has been omitted for the sake of clarity.

As shown in FIG. 8, a layer of adhesive such as pressure sensitive adhesive 104 may be formed on ledge 82 of peripheral conductive housing structures 12W. When display cover layer 26 is pressed onto ledge 82 during assembly, this pressure may activate pressure sensitive adhesive 104 to adhere display cover layer 26 to ledge 82. Pressure sensitive adhesive 104 may include notches or gaps such as gaps 106. End 96 of bridging structure 60-1 may be coupled to ledge 82 within a first notch 106 in pressure sensitive adhesive 104. End 98 of bridging structure 60-3 may be coupled to ledge 82 within a second notch 106 in pressure sensitive adhesive 104. End 100 of bridging structure 60-1 and end 102 of bridging structure 60-3 may be coupled to conductive display structures 32 (e.g., at terminals 64-1 and 64-3 of FIG. 7, respectively).

End 96 of bridging structure 60-1 and end 98 of bridging structure 60-3 may include adhesive that is used to help secure display cover layer 26 (FIG. 6) to ledge 82. If desired, end 96 of bridging structure 60-1 and end 98 of bridging structure 60-3 may each include conductive tape that is folded around a layer of heat-activated film. The heat-activated film may allow the display cover layer to be mounted flush with the top surface of peripheral conductive housing structures 12W during assembly, for example. Similar structures may be used to form one or more (e.g., all) of the bridging structures 60 overlapping antenna 40-1.

Figure 9:
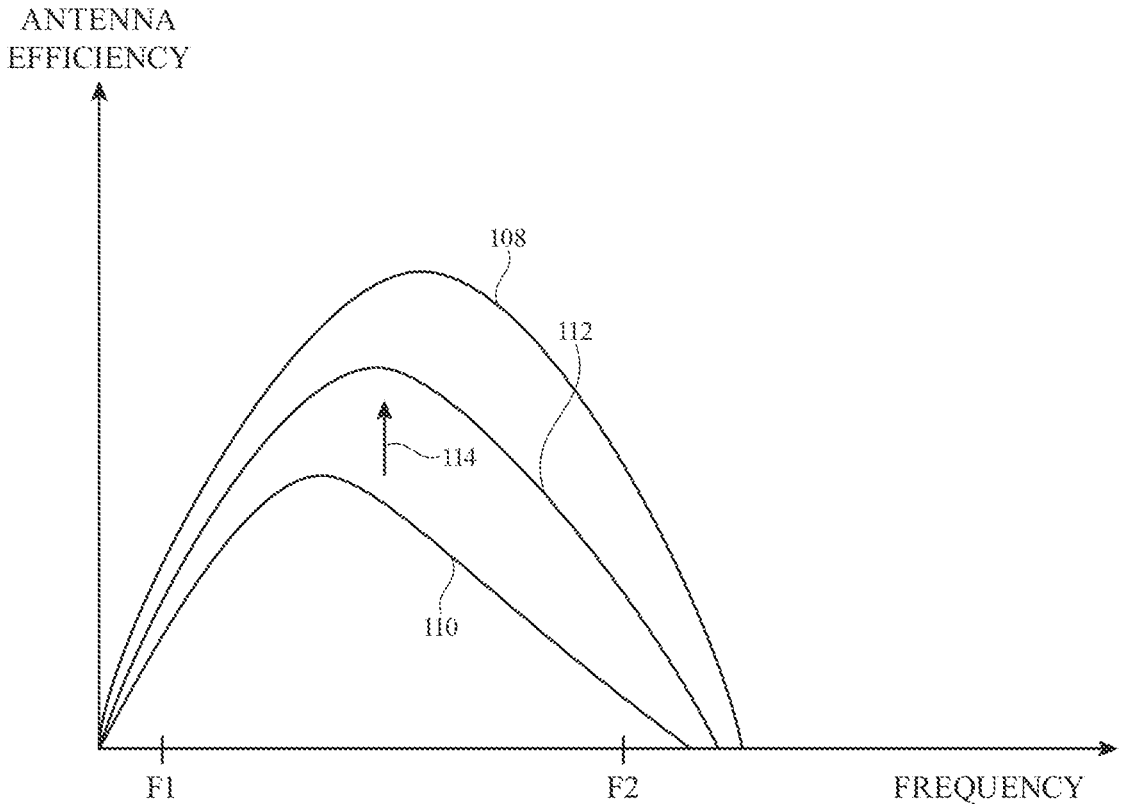
FIG. 9 is a plot of antenna performance (antenna efficiency) as a function of frequency for an antenna of the type shown in FIGS. 3-7 in accordance with an embodiment.

FIG. 9 is a graph in which antenna performance (antenna efficiency) through display 14 has been plotted as a function of operating frequency for antenna 40-1 of FIGS. 5-7. As shown in FIG. 9, curve 108 plots the antenna efficiency of the antenna 40-1 in the absence of display 14 (e.g., prior to mounting display 14 to peripheral conductive housing structures 12W). As shown by curve 108, antenna 40-1 may exhibit a relatively high efficiency across a corresponding frequency band from frequency F1 to frequency F2 (e.g., a wireless local area network band at 2.4 GHz).

Curve 110 plots the antenna efficiency for antenna 40-1 in the presence of display 14 (e.g., after mounting display 14 to peripheral conductive housing structures 12W) and in the absence of bridging structures 60. As shown by curve 110, out-of-phase currents I3 and I4 on ledge 82 and conductive display structures 32 (FIG. 7) may significantly reduce the efficiency of antenna 40-1 between frequencies F1 and F2.

Curve 112 plots the antenna efficiency for antenna 40-1 when conductive display structures 32 are coupled to peripheral conductive housing structures 12W using one or more bridging structures 60. The presence of bridging structures 60 may align the phases of currents I3 and I4 to minimize the electromagnetic impact of conductive display structures 32 on the radio-frequency signals propagating through display 14. This may serve to increase antenna efficiency between frequencies F1 and F2 relative to scenarios where bridging structures 60 are omitted from device 10, as shown by arrow 114.

The example of FIG. 9 is merely illustrative. In practice, curves 108, 112, and 110 may have different shapes. Antenna 40-1 may exhibit any desired number of response peaks in any desired frequency bands. Similar structures may be used to optimize antenna efficiency through display 14 for any desired antennas 40 in device 10.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a conductive housing;

a display having a conductive display structure and a display cover layer, wherein the display cover layer overlaps the conductive display structure and is mounted to the conductive housing;

a gap that separates the conductive housing from the conductive display structure;

an antenna having a slot element and an antenna feed coupled across the slot element, wherein the slot element is configured to convey radio-frequency signals through the gap and the display cover layer; and a conductive bridging structure coupled between the conductive housing and the conductive display structure across the gap, wherein the conductive bridging structure at least partially overlaps the slot element.

2. The electronic device defined in claim 1, wherein the slot element has a first edge and the conductive bridging structure at least partially overlaps the first edge.

3. The electronic device defined in claim 2, wherein the slot element has a second edge opposite the first edge, a third edge extending between the first and second edges, and a fourth edge opposite the third edge that extends between the first and second edges, the antenna feed being coupled to the third and fourth edges.

4. The electronic device defined in claim 3, wherein the conductive housing comprises peripheral conductive housing structures that define the third edge of the slot element and a conductive rear housing wall that defines the fourth edge of the slot element.

5. The electronic device defined in claim 4, wherein the slot element has a length extending between the first and second edges that is approximately equal to one-half of a wavelength in a wireless local area network communications band.

6. The electronic device defined in claim 3, further comprising:

an additional conductive bridging structure coupled between the conductive housing and the conductive display structure across the gap, wherein the additional conductive bridging structure at least partially overlaps the second edge of the slot element.

7. The electronic device defined in claim 2, wherein the antenna comprises a tuning element coupled across the slot element at a given location along a length of the slot element, the electronic device further comprising:

an additional conductive bridging structure coupled between the conductive housing and the conductive display structure, wherein the additional conductive bridging structure is aligned with the given location along the length of the slot.

8. The electronic device defined in claim 7, wherein the additional conductive bridging structure comprises a conductive bridging structure selected from the group consisting of: a conductive clip and a conductive air loop gasket.

9. The electronic device defined in claim 1, wherein the conductive housing comprises peripheral conductive housing structures extending around a periphery of the electronic device, the peripheral conductive housing structures comprise a ledge, the display cover layer is mounted to the ledge, and the conductive bridging structure is coupled to the ledge.

10. The electronic device defined in claim 9, wherein a portion of the conductive bridging structure is interposed between the ledge and the display cover layer.

11. The electronic device defined in claim 9, wherein the conductive bridging structure comprises a conductive structure selected from the group consisting of: conductive tape, a conductive gasket, a conductive spring, a conductive wire, and conductive foam.

12. The electronic device defined in claim 1, wherein the electronic device has opposing front and rear faces, the display cover layer is formed at the front face, and the slot element is formed at the rear face.

13. An electronic device comprising:

an antenna resonating element having a length;

an antenna feed coupled to the antenna resonating element and configured to convey an antenna current over the length of the antenna resonating element;

a first conductive structure;

a second conductive structure separated from the first conductive structure by a gap, wherein the antenna resonating element is configured to convey radio-frequency signals associated with the antenna current through the gap; and a third conductive structure coupled between the first and second conductive structures across the gap, wherein the third conductive structure at least partially overlaps a location along the length of the antenna resonating element where the antenna current exhibits a maximum magnitude.

14. The electronic device defined in claim 13, wherein the antenna resonating element is configured to induce a first current on the first conductive structure and a second current on the second conductive structure, the third conductive structure being configured to align a phase of the first current with a phase of the second current.

15. The electronic device defined in claim 13, further comprising:

peripheral conductive housing structures; and a display having conductive display structures and a display cover layer, wherein the first conductive structure comprises a ledge portion of the peripheral conductive housing structures, the display cover layer being mounted to the ledge portion of the peripheral conductive housing structures.

16. The electronic device defined in claim 15, wherein the conductive display structures comprise the second conductive structure.

17. The electronic device defined in claim 16, wherein the antenna resonating element comprises a slot antenna resonating element having a first edge defined by the peripheral conductive housing structures.

18. The electronic device defined in claim 17, further comprising:

a conductive housing wall that defines a second edge of the slot antenna resonating element.

19. An electronic device comprising:

peripheral conductive housing structures;

a conductive rear housing wall;

a slot element having opposing edges defined by the peripheral conductive housing structures and the conductive rear housing wall;

an antenna feed coupled to the peripheral conductive housing structures and the conductive rear housing wall across the slot element;

an antenna tuning element coupled between the peripheral conductive housing structures and the conductive rear wall across the slot element;

a display having a display cover layer and conductive display structures, wherein the display cover layer is mounted to the peripheral conductive housing structures and overlaps the slot element, the conductive housing wall, and the conductive display structures; and a conductive structure coupled between the conductive display structures and the conductive rear housing wall, wherein the conductive structure is aligned with the antenna tuning element.

20. The electronic device defined in claim 19, wherein the slot element is configured to induce a first current on the peripheral conductive housing structures and a second current on the conductive display structures, the conductive structure being configured to align a phase of the first current with a phase of the second current.

* * * * *